US007179121B1

(12) United States Patent
Burris et al.

(10) Patent No.: US 7,179,121 B1
(45) Date of Patent: Feb. 20, 2007

(54) COAXIAL CABLE CONNECTOR

(75) Inventors: Donald A. Burris, Peoria, AZ (US); William B. Lutz, Glendale, AZ (US)

(73) Assignee: Corning Gilbert Inc., Glendale, AZ (US)

( * ) Notice: Subject to any disclaimer, the term of this patent is extended or adjusted under 35 U.S.C. 154(b) by 0 days.

(21) Appl. No.: 11/234,017

(22) Filed: Sep. 23, 2005

(51) Int. Cl.
*H01R 9/05* (2006.01)

(52) U.S. Cl. ..... 439/578

(58) Field of Classification Search ..... 439/578, 439/584, 585, 583, 320, 322, 675
See application file for complete search history.

(56) References Cited

U.S. PATENT DOCUMENTS

| | | | | |
|---|---|---|---|---|
| 4,135,776 | A | 1/1979 | Ailawadhi et al. | 339/177 R |
| 4,408,822 | A | 10/1983 | Nikitas | 339/177 R |
| 4,613,199 | A | 9/1986 | McGeary | 339/177 R |
| 4,755,152 | A * | 7/1988 | Elliot et al. | 439/452 |
| 4,834,675 | A | 5/1989 | Samchisen | 439/578 |
| 5,295,863 | A * | 3/1994 | Cady | 439/578 |
| 5,362,250 | A * | 11/1994 | McMills et al. | 439/387 |
| 5,466,173 | A * | 11/1995 | Down | 439/584 |
| 6,352,448 | B1 * | 3/2002 | Holliday et al. | 439/585 |
| 6,517,379 | B2 * | 2/2003 | Leve | 439/578 |
| 2005/0032422 | A1 * | 2/2005 | Montena et al. | 439/583 |

OTHER PUBLICATIONS

PPC, "EX11 Screw Post Design", 1 page.

* cited by examiner

*Primary Examiner*—Alexander Gilman
(74) *Attorney, Agent, or Firm*—Joseph M. Homa; Michael Leetzow

(57) ABSTRACT

A connector for coaxial cable is disclosed herein which has hollow body with a tubular post having at least one thread thereon and a dielectric member with a pin that rotate together relative to the remainder of the coaxial cable connector. A related method and tool for connecting the coaxial cable and connector are also disclosed.

29 Claims, 9 Drawing Sheets

COAXIAL CABLE CONNECTOR

BACKGROUND OF THE INVENTION

1. Field of the Invention

The present invention relates generally to coaxial cable connectors, and particularly to coaxial cable connectors capable of being connected to a terminal.

2. Technical Background

Coaxial cable connectors such as F-connectors are used to attach coaxial cables to another object such as an appliance or junction having a terminal adapted to engage the coaxial cable connector. Coaxial cable F-connectors are often used to terminate a drop cable in a cable television system. The coaxial cable typically includes a center conductor surrounded by a dielectric, in turn surrounded by a conductive grounding foil and/or braid (hereinafter referred to as a conductive grounding sheath); the conductive grounding sheath is itself surrounded by a protective outer jacket. The F-connector is secured over the prepared end of the jacketed coaxial cable, allowing the end of the coaxial cable to be connected with a terminal block, such as by a threaded connection with a threaded terminal of a terminal block.

Coaxial cable connectors can be installed on the coaxial cable either by crimping the coaxial cable connector to the cable or by axial compression. These compression connectors are installed onto prepared cables by inserting the exposed cable core (dielectric and center conductor) into the connector and, more specifically, a post or support sleeve on the inside of the coaxial cable connector. The post is interposed between the cable core (dielectric and center conductor) and the conductive grounding sheath. The post is typically driven into the coaxial cable by a back-and-forth twisting motion while pushing the coaxial cable connector onto the coaxial cable by hand. On those coaxial cables that have a PVC jacket, this process can typically be performed quite easily because the PVC jacket is able to easily stretch to accommodate the post. However, on plenum-rated coaxial cables, the jacketing material is required to be a tougher material and is much more resistant to stretching and deformation. Thus, the termination of the plenum rated cables is extremely difficult, if not close to impossible, using standard techniques and materials.

Some of the coaxial cable connectors that have been developed for the plenum-rated coaxial cables require special tools or a larger number of components. Some of the connectors used with the plenum-rated coaxial cables also utilize multiple piece connectors with a hex crimp ferrule. However, hex crimp ferrules do not completely secure the jacket and allow the coaxial cables to be pulled out of the connectors. Additionally, the hex crimp connectors do not provide satisfactory moisture protection, allowing moisture to enter the coaxial cable connector, which can lead to corrosion, increased contact resistance, reduced signal strength, and excessive RF leakage from the connector. Therefore, a coaxial cable connector that can be inserted onto all types of coaxial cables is needed.

SUMMARY OF THE INVENTION

To achieve these and other advantages and in accordance with the purpose of the invention as embodied and broadly described herein, the invention is directed in one aspect to a connector for coupling an end of a coaxial cable to a terminal, the coaxial cable having an inner conductor, a dielectric surrounding the inner conductor, an outer conductor surrounding the dielectric, a braided shield surrounding the dielectric, and a jacket surrounding the braided shield, the connector having a hollow body having a rear end, a front end, and an internal surface extending between the rear and front ends of the body, the internal surface defining a longitudinal opening, a tubular post disposed at least partially within the longitudinal opening of the hollow body, the tubular post having a rear end, an inner surface and an outer surface, the rear end of the tubular post having at least one thread on the outer surface, and wherein at least a portion of the outer surface of the tubular post and at least a portion of the internal surface of the hollow body define an annular cavity therebetween, an insulating member disposed within the longitudinal opening of the hollow body, the insulating member having a front end, a rear end, and an opening extending between the front and rear ends, at least a portion of rear end of the insulating member disposed against a portion of the inner surface of the tubular post, and a pin inserted into and substantially along the opening of the insulating member, wherein the pin and insulating member are rotatable together relative to the hollow body member and tubular post.

In another aspect, a connector is disclosed herein for coupling an end of a coaxial cable to a terminal, the coaxial cable having an inner conductor, a dielectric surrounding the inner conductor, an outer conductor surrounding the dielectric, a braided shield surrounding the dielectric, and a jacket surrounding the braided shield, the connector having a hollow body having a rear end, a front end, and an internal surface extending between the rear and front ends of the body, the internal surface defining a longitudinal opening, a compression ring comprising a rear end, a front end surrounding the hollow body, and an inner surface defining a longitudinal opening extending between the rear and front ends of the compression ring, a tubular post disposed at least partially within the longitudinal opening of the hollow body, the tubular post having a rear end, an inner surface and an outer surface, the rear end of the tubular post having at least one thread on the outer surface, and wherein at least a portion of the outer surface of the tubular post and at least a portion of the internal surface of the body define an annular cavity therebetween, an insulating member disposed within the longitudinal opening of the hollow body, the insulating member having a front end, a rear end, and an opening extending between the front and rear ends, at least a portion of rear end of the insulating member disposed within the annular cavity of the tubular post, a pin inserted into and substantially along the opening of the insulating member, wherein the pin and insulating member are rotatable together relative to the hollow body member and tubular post, and a deformable gripping ring disposed between the hollow body and the inner surface of the compression ring, the gripping ring comprising a rear end, a front end, an outer surface, and an inner surface, wherein the compression ring is axially movable over the hollow body between a rearward position and a forward position, wherein, in the rearward position, the inner surface at the rear end of the gripping ring has a rear inner diameter, and the inner surface at the front end of the gripping ring has a front inner diameter, and wherein, in the forward position, the gripping ring is compressed between the hollow body and the compression ring, the rear end of the gripping ring has a reduced rear inner diameter less than the rear inner diameter, and the front end of the gripping ring has a reduced front inner diameter less than the second front diameter.

In yet another aspect, disclosed herein is a combination of a coaxial cable and a connector for coupling an end of the coaxial cable to a terminal, the coaxial cable having an inner conductor, a dielectric surrounding the inner conductor, an outer conductor surrounding the dielectric, a braided shield surrounding the dielectric, and a jacket surrounding the braided shield, the connector having a hollow body having a rear end, a front end, and an internal surface extending between the rear and front ends of the body, the internal surface defining a longitudinal opening, a tubular post disposed at least partially within the longitudinal opening of the hollow body, the tubular post having a rear end, an inner surface and an outer surface, the rear end of the tubular post having at least one thread on the outer surface, and wherein at least a portion of the outer surface of the tubular post and at least a portion of the internal surface of the hollow body define an annular cavity therebetween, wherein the inner surface is configured to allow the dielectric and the inner conductor to enter the tubular post and to allow the braided shield and the jacket to enter the annular cavity, an insulating member disposed within the longitudinal opening of the hollow body, the insulating member having a front end, a rear end, and an opening extending between the front and rear ends, at least a portion of rear end of the insulating member disposed against a portion of the inner surface of the tubular post and sized to receive a portion of the dielectric, and a pin inserted into the opening of the insulating member, wherein the pin and insulating member are rotatable together relative to the hollow body member and tubular post, and wherein a portion of the pin surrounds a portion of the inner conductor thereby being in electrical communication therewith.

In another aspect, a method is disclosed for coupling a coaxial cable to a terminal, the coaxial cable comprising an inner conductor, a dielectric surrounding the inner conductor, an outer conductor surrounding the dielectric, a braided shield surrounding the dielectric, and a jacket surrounding the braided shield, the method including providing a coaxial connector having a hollow body, a tubular post having at least one thread on an outer surface, an insulating member disposed within the hollow body, and a pin disposed within a longitudinal opening in the insulating member, rotating the hollow body with respect to the coaxial cable, thereby causing the tubular post to rotate with respect to the coaxial cable, and engaging the coaxial cable with the tubular post while rotating the coaxial cable connector, wherein the at least one thread draws the braided shield and jacket into an annular opening between the hollow body and the outer surface of the tubular post and longitudinally advances the coaxial connector onto the coaxial cable thereby causing the inner conductor of the coaxial cable to engage the pin, wherein the pin and the insulating member rotate with the coaxial cable relative to the post and body when the pin frictionally engages the inner conductor and the coaxial cable does not substantially rotate with respect to the coaxial cable connector during the installation.

In still another aspect, an interface tool is disclosed to assist in coupling an end of a coaxial cable with a coaxial cable connector, the interface tool having an elongated body having a first end and a second end, the second end having threads on an outside surface thereof to engage the coaxial cable connector, a first opening into the elongated body through the second end, the first opening being parallel to a longitudinal axis of the elongated body and sized to receive a conductor protruding from the end of the coaxial cable connector, and at least one second opening in the elongated body, the at least one second opening spaced from the second end of the elongated body and being orthogonal to and in communication with the first opening.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description of the present embodiments of the invention, and are intended to provide an overview or framework for understanding the nature and character of the invention as it is claimed. The accompanying drawings are included to provide a further understanding of the invention, and are incorporated into and constitute a part of this specification. The drawings illustrate various embodiments of the invention, and together with the description serve to explain the principles and operations of the invention.

DETAILED DESCRIPTION OF THE PREFERRED EMBODIMENTS

Figure 1:
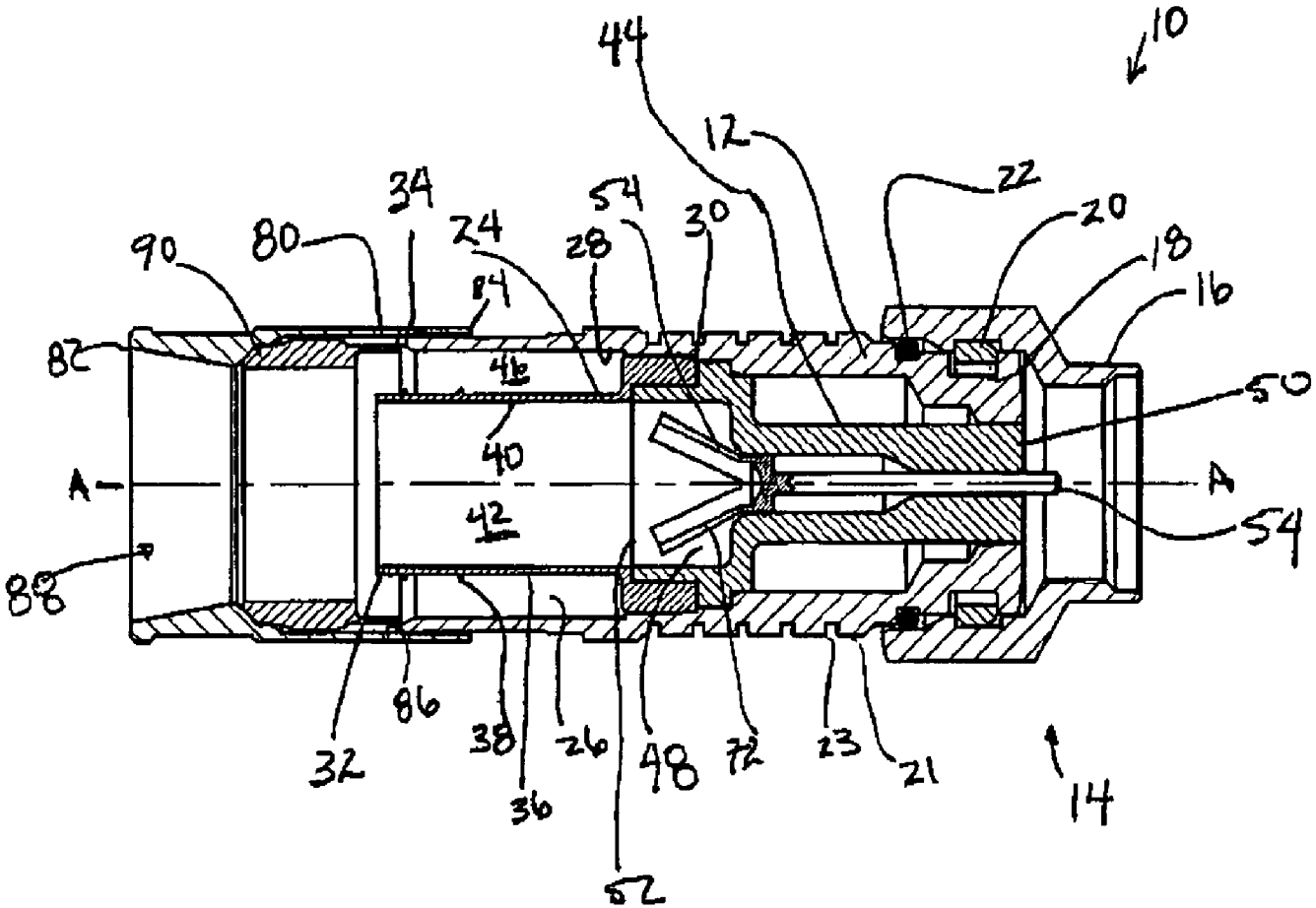
FIG. 1 is a side cutaway view along the centerline of one preferred embodiment of a connector according to the present invention.
Figure 3:
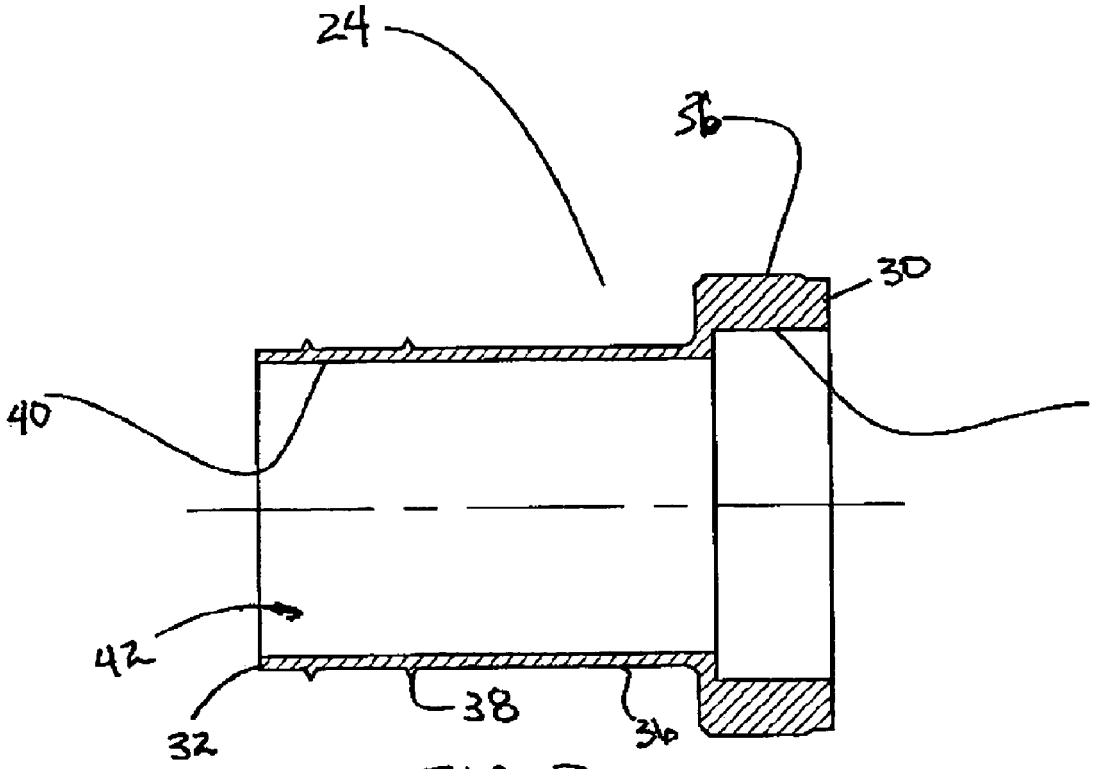
FIG. 3 is side cutaway view of the connector part of FIG. 2.
Figure 2:
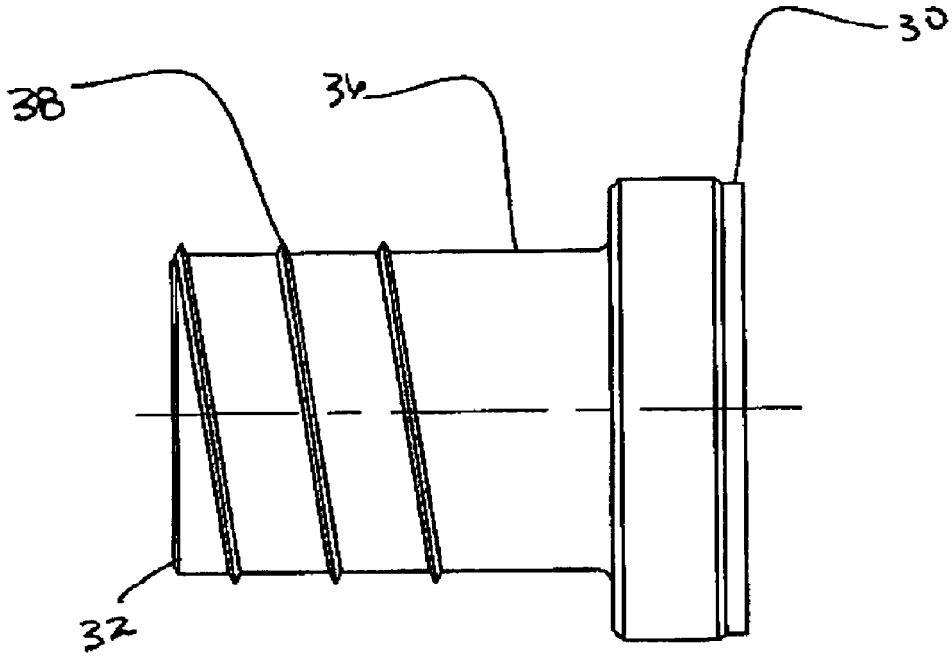
FIG. 2 is an enlarged view of part of the connector in FIG. 1.

Reference will now be made in detail to the present preferred embodiment(s) of the invention, examples of which are illustrated in the accompanying drawings. Whenever possible, the same reference numerals will be used throughout the drawings to refer to the same or like parts. One embodiment of the present invention is shown in FIG. 1 and is designated generally throughout by the reference numeral 10.

Figure 9:
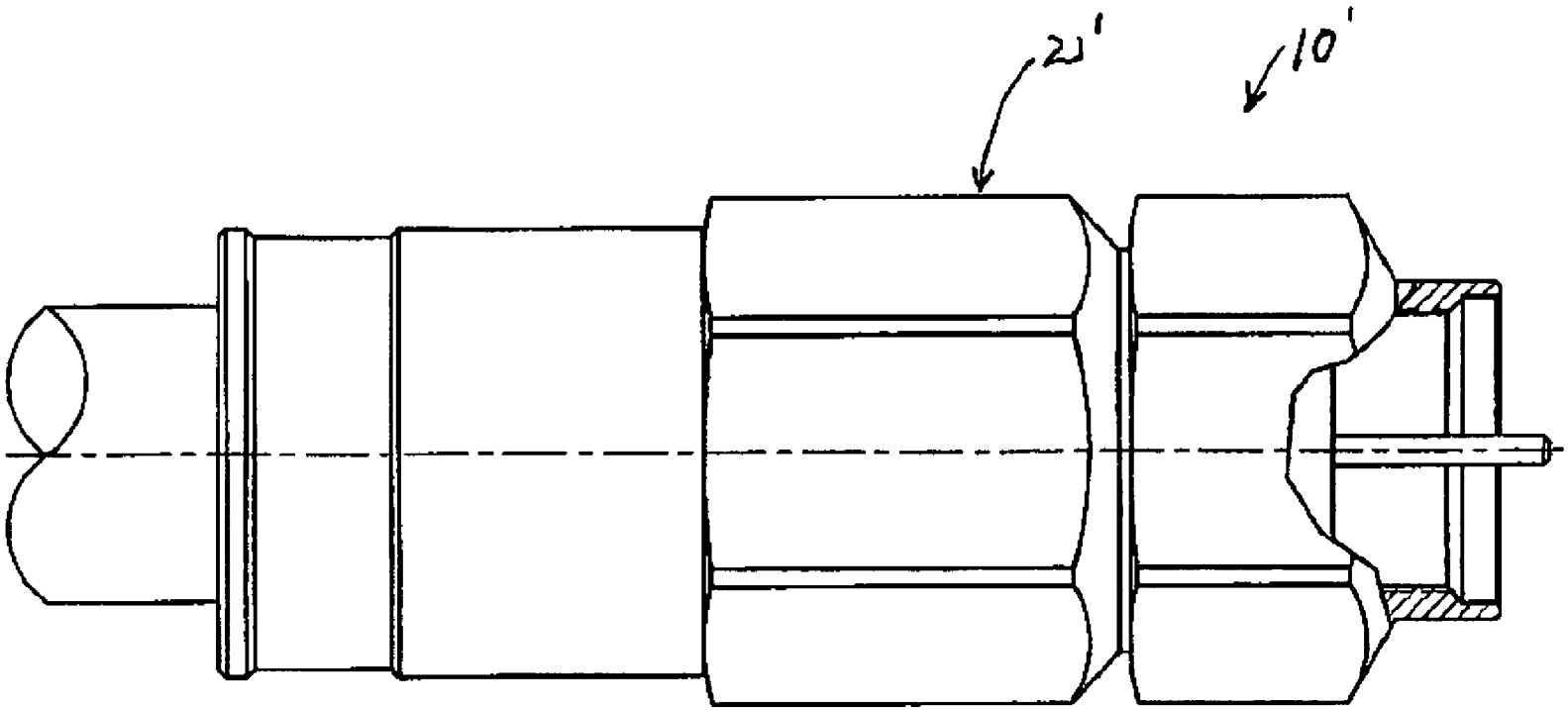
FIG. 9 is a side view of another embodiment of a connector according to the present invention with a portion cutaway.
Figure 11:
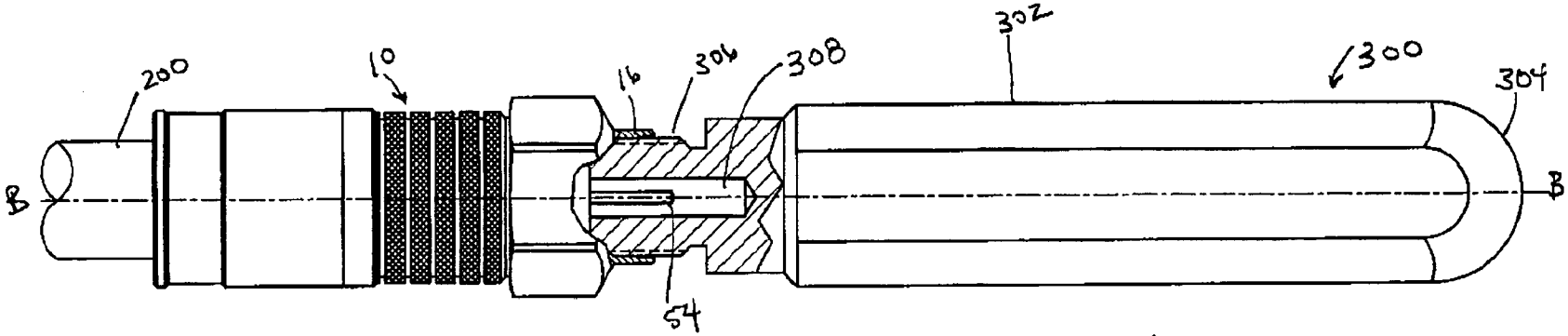
FIG. 11 PRIOR ART
FIG. 11 is a partial cutaway view of the interface tool of FIG. 10.
Figure 10:
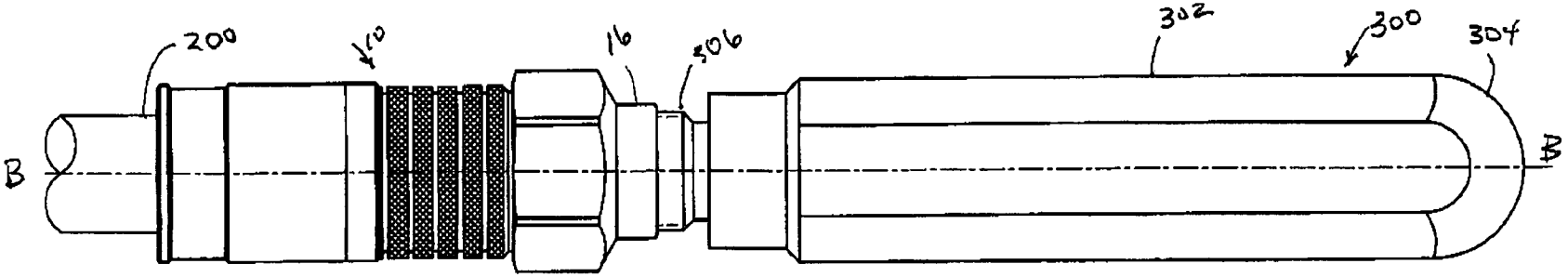
FIG. 10 PRIOR ART
FIG. 10 is an interface tool according to the prior art engaging a coaxial cable connector.
Figure 12:
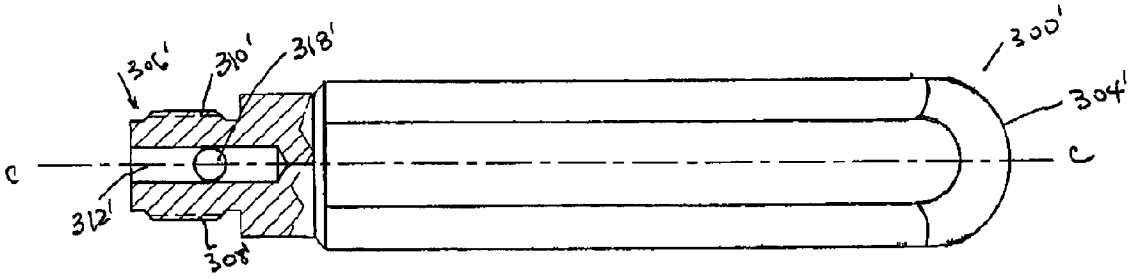
FIG. 12 is a partial cutaway view of an interface tool according to the present invention.
Figure 13:
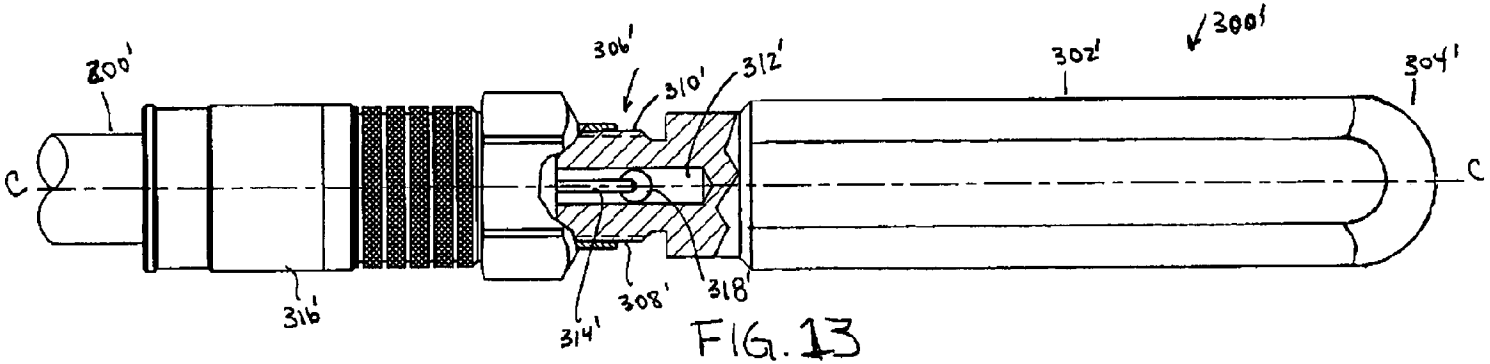
FIG. 13 is a partial cutaway view of the interface tool of FIG. 12 engaging a coaxial cable connector.
Figure 14:
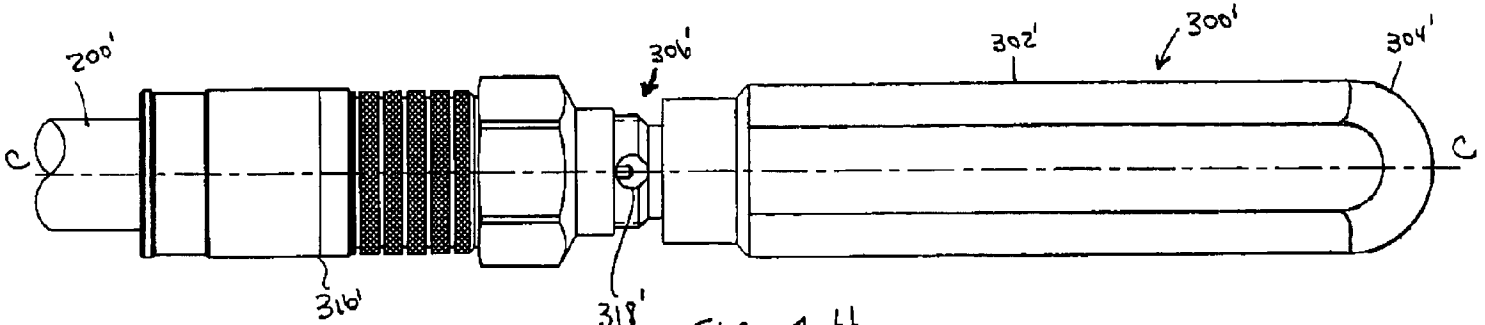
FIG. 14 is a view of the interface tool of FIG. 12 engaging a coaxial cable connector.

FIG. 1 schematically illustrates one preferred embodiment of a coaxial cable connector, as disclosed herein, in an open configuration. FIGS. 2–4A illustrate components of the coaxial cable connector 10 in greater detail. FIGS. 5–8 illustrate the coaxial cable connector 10 being inserted onto a coaxial cable 200. FIG. 9 illustrates an alternative embodiment of a coaxial cable connector according to the present invention. FIGS. 10–11 illustrate a prior art interface tool used to attach a coaxial cable connector to a coaxial cable. FIGS. 12–14 illustrate one embodiment of an interface tool according to the present invention.

Coaxial cable connector 10 couples an end of a coaxial cable 200 to a terminal. The coaxial cable 200 shown in FIG. 5 comprises an inner conductor 202, a dielectric layer (or, simply, dielectric) 204 surrounding the inner conductor 202, an outer conductor 206 surrounding the dielectric 204, a braided shield 208 surrounding the dielectric 204, and a jacket 210 surrounding the braided shield 208.

The coaxial cable connector 10 preferably has a hollow body 12 that is preferably made of metal, such as brass, and is more preferably plated with a conductive, corrosion resistant material such as nickel. Hollow body 12 has a longitudinal axis A—A. At the front end 14 of coaxial cable connector 10 is a coupler, shown as embodied by a coupling nut 16, which preferably has a construction similar to that of the hollow body 12. The coupling nut 16 is shown with a generally hexagonal outer configuration with internal threads for engaging an appliance or junction having a terminal. The coaxial cable connector 10 may instead comprise another interface, such a BNC coupler interface or RCA coupler interface. At the front end 14 of hollow body 12 is a groove 18 that accepts a snap ring 20, which allows rotation of the coupling nut 16 about the hollow body 12. Also disposed between the hollow body 12 and the coupling nut 16 and rearwardly from the snap ring 20 is an O-ring 22, which provides a barrier against moisture ingress from behind the coupling nut 16. The O-ring 22 may be made of any appropriate material, but is preferably made of a rubber compound such as EPDM. The outer surface of hollow body 12 preferably has a knurled surface 21 with grooves 23 (See FIG. 7) to allow a user to more easily grip the coaxial cable connector 10. The knurled surface 21 may be of any pattern or pitch. Other surface configurations are also possible as long as they allow the user to easily maintain a grip on the coaxial cable connector 10.

The coaxial cable connector 10 has a number of internal components. First, a tubular post 24 is press-fit into the longitudinal opening 26 and against the internal surface 28 of the hollow body 12. Since the tubular post 24 is press-fit into the longitudinal opening 26, it does not move relative to the hollow body 12. The tubular post 24 has a front end 30 that engages the internal surface 28 of the hollow body 12 and a rear end 32 that preferably protrudes from the rear end 34 of the hollow body 12. As shown in more detail in FIGS. 2 and 3, the outer surface 36 of the tubular post 24 has at least one thread 38 to engage the coaxial cable 200. When the tubular post 24 is rotated with respect to the cable 200, the thread 38 acts like an auger to pull the coaxial cable 200, and especially the braided shield 208, onto the tubular post 24. The thread 38 also provides a surface feature to increase the retention forces of the coaxial cable 200 on the coaxial cable connector 10 to help prevent the cable 200 from being pulled out of the connector 10. The thread 38 illustrated in the embodiment has three complete, contiguous turns, but the thread 38 may have fewer or more, and the thread 38 may also be interrupted (i.e., not continuous) and still come within the scope of the present invention. The tubular post 24 also has an inner surface 40 that defines an opening 42 that allows for at least a portion of the coaxial cable 200 to enter into and move through the tubular post 24. The opening 42 has a larger diameter at the front end 30 to allow it to receive a portion of a dielectric member 44, discussed in more detail below.

The outer surface 36 of the tubular post 24 and the internal surface 28 of the hollow body 12 define an annular cavity 46 to accept the cable jacket 210 and braided shield 208 as is also described in more detail below.

The hollow body 12 also has an insulator or dielectric member 44 disposed in a portion of the longitudinal opening 26 and against the internal surface 28 of the hollow body 12. The dielectric member 44 is preferably made of an insulative plastic material such as high-density polyethylene or acetyl. Preferably, the dielectric member 44 is electrically tuned to a predetermined impedance as necessary for operation of the coaxial cable connector 10. As the dielectric member 44 is made from an insulative material that has a relatively low coefficient of friction, it is substantially free to rotate about the longitudinal axis A—A inside the longitudinal opening 26 even though it may touch the internal surface 28 of the hollow body 12. The dielectric member 44 also has an opening 48 that extends between the front end 50 and rear end 52 to receive a pin 54. The opening 48 is preferably larger in diameter at the rear end 52 to accommodate a portion of the dielectric 204 of coaxial cable 200 and a flared portion of pin 54, as discussed in detail below. The opening 48 also has a central portion 56 that has a smaller diameter than the diameter at the rear end 52 of the dielectric member 48, but has a larger diameter than the front portion 58 of the opening 48, which has the smallest diameter.

Figure 4A:
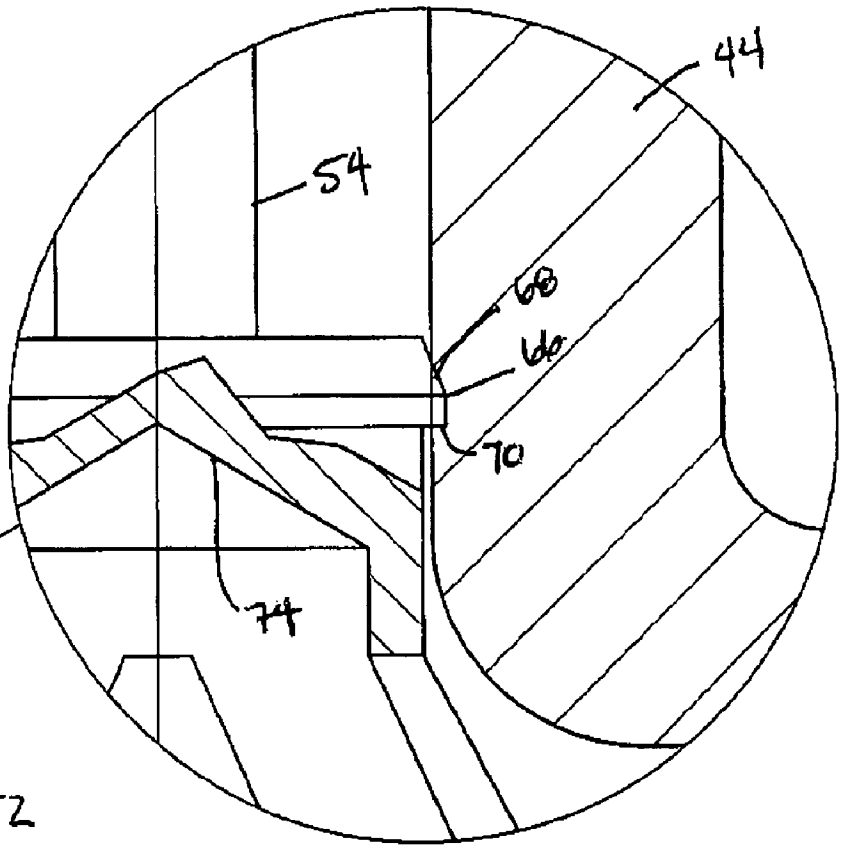
FIG. 4A is an enlarged cutaway view of a portion of the connector part of FIG. 4.
Figure 4:
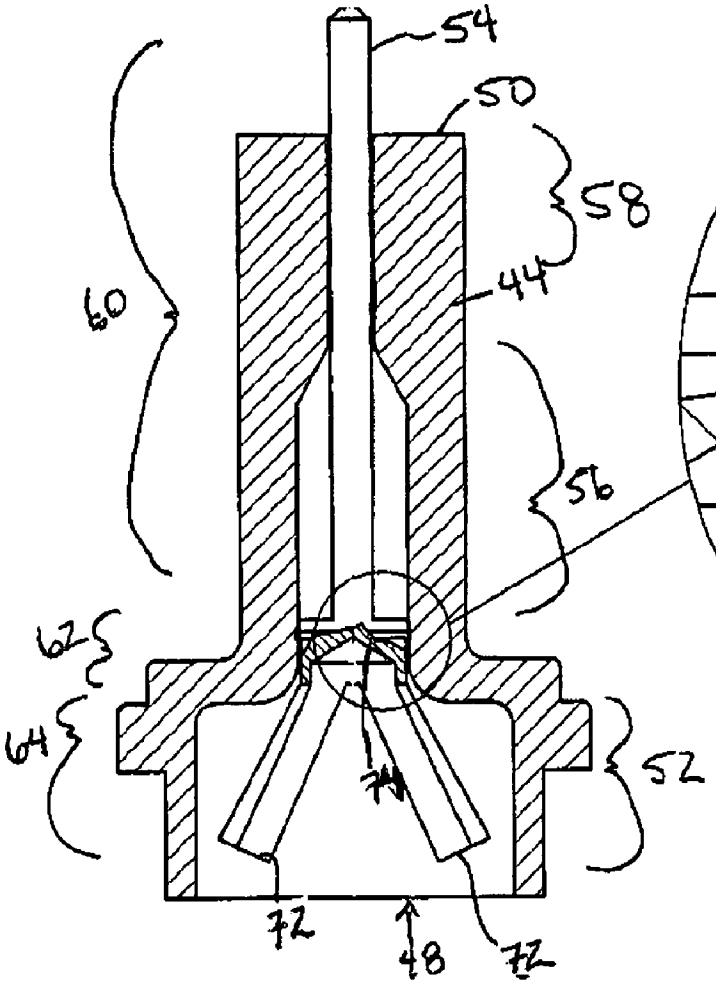
FIG. 4 is a partial cutaway side view of another part of the connector of FIG. 1.

As shown in FIGS. 1, 4, and 4A, the pin 54 is disposed in the opening 48. The pin 54 has elongated front portion 60, a central portion 62, and a rear portion 64, which is preferably flared. The central portion 62 preferably includes an extension 66, as illustrated in more detail in FIG. 4A. The extension 66 extends outwardly from the central portion of pin 54 to engage the dielectric member 44. As can be seen in more detail in FIG. 4 A, the extension 66 has a forward facing surface 68 to allow pin 54 to move longitudinally toward the front end of dielectric member 44. The extension 66 also has a rear perpendicular face 70 to help prevent the pin 54 from moving in a rearwardly direction in dielectric member 44. As can be seen in FIG. 4, the extension 66 preferably runs around the circumference of pin 54 at the central portion 62. However, it should be noted, that the extension 66 need not completely encircle pin 54 and it may also be broken into a number of discrete portions (e.g., 1, 2, 3, etc.).

The rear portion 64 of pin 54 preferably includes a plurality of tines 72 that are flared into an open state and provide a guide for the inner conductor 202 of the coaxial cable 200. Four tines are illustrated in the embodiment shown in the figures. As coaxial cable 200 is inserted into coaxial cable connector 10, the inner conductor 202 physically engages the inside surface 74 of pin 54. As the coaxial cable 200 is further inserted into coaxial cable connector 10, pin 54 is pushed by the inner conductor 202 longitudinally through dielectric member 44. The shoulder formed at the reduced diameter of the central portion 56 of opening 48 causes the tines 72 to fold down and engage the inner conductor 202 as the pin 54 moves longitudinally along opening 48. In a preferred embodiment, the tines 72 may also have teeth or radially inward projections thereon to assist in engaging the inner conductor 202.

Preferably, the pin 54 is made of metallic material, such as brass, and is even more preferably plated with a conductive, corrosion resistant material such as tin or nickel-tin.

The coaxial cable connector 10 also includes a compression ring 80. The compression ring 80 also includes a rear end 82, a front end 84, and an inner surface 86, which defines a longitudinal hole 88 that extends between front end 84 and rear end 82. The front end 84 of compression ring 80 surrounds and contacts hollow body 12 of coaxial cable connector 10. A deformable gripping ring 90 is disposed between the inner surface 86 of compression ring 80 and hollow body 12. The operation of compression ring 80 in conjunction with deformable gripping ring 90 and hollow body 12 are more fully described in co-pending application Ser. No. 11/012,507, filed on Dec. 14, 2004, and assigned to the same assignee and incorporated herein in its entirety by reference, and also application Ser. No. 11/233,887, filed concurrently herewith, which is a continuation-in-part of application Ser. No. 11/012,507, also incorporated herein in its entirety by reference.

Figure 5:
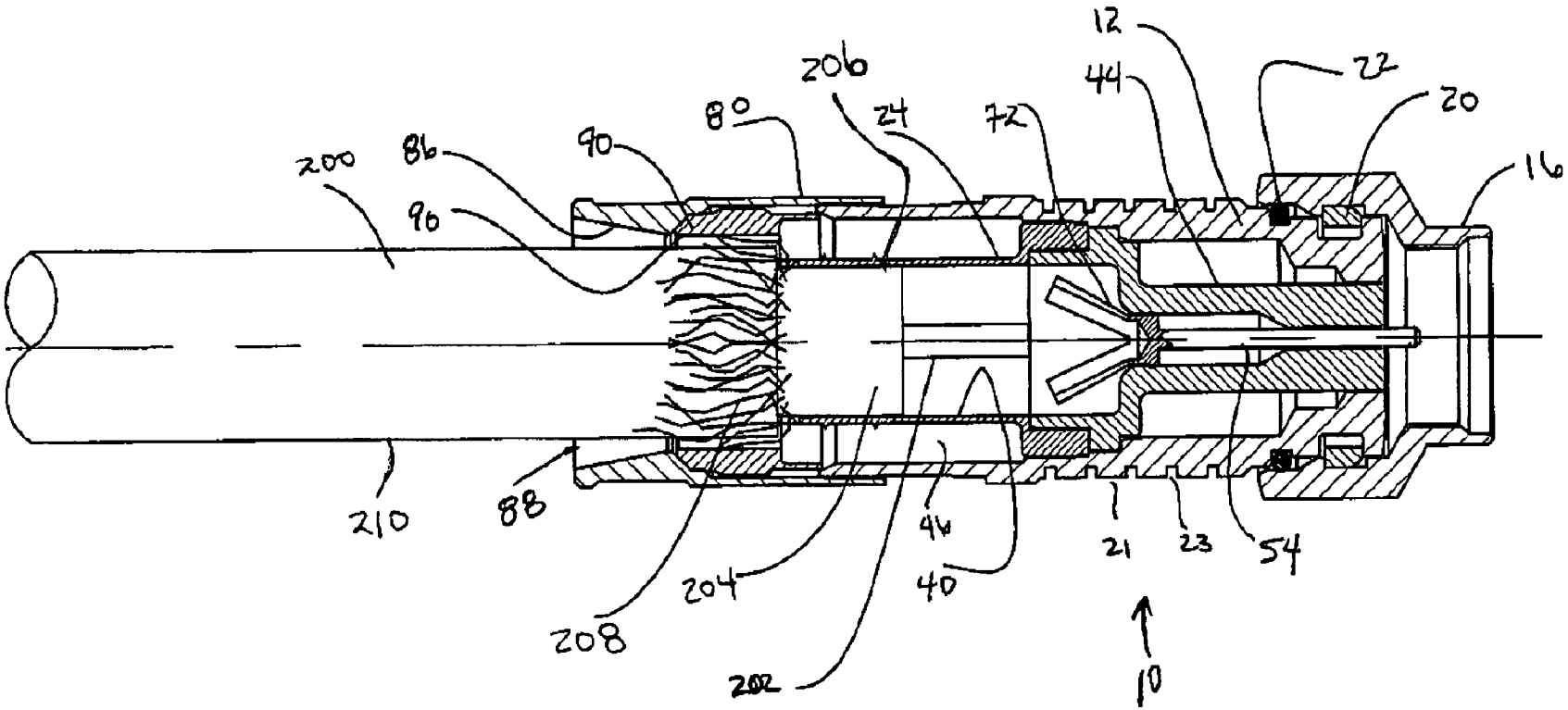
FIG. 5 is a side cutaway view of the connector of FIG. 1 with a coaxial cable being inserted.
Figure 6:
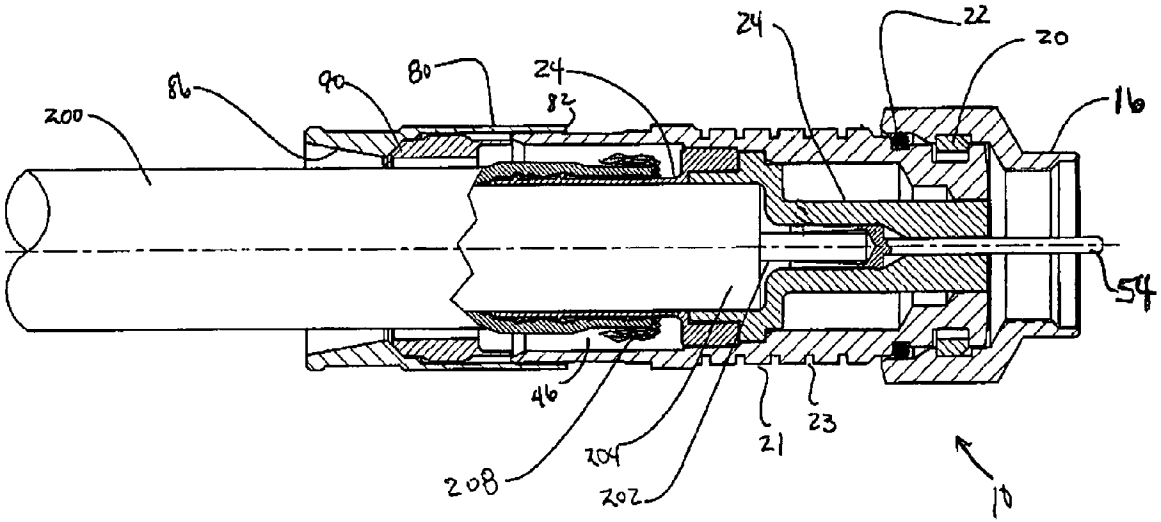
FIG. 6 is a side cutaway view of the connector of FIG. 1 with the coaxial cable fully inserted into the connector and prior to axial compression of the connector.

The installation of coaxial cable connector 10 onto coaxial cable 200 will now be described in reference to FIGS. 5–8. In FIG. 5, coaxial cable 200 has been prepared for insertion into the coaxial cable connector 10. As is known in the art, the inner conductor 202 is coaxial cable connector 10 exposed for a predetermined length, while the dielectric layer 204 is also exposed. The braided shield 208 that had covered the dielectric layer 204 is folded back over and on top of the jacket 210 prior to insertion of the coaxial cable 200 into the coaxial cable connector 10. The end of coaxial cable 200 is then inserted into the coaxial cable connector 10 through the rear end 82 of compression ring 80, the deformable gripping ring 90, and into the longitudinal opening 26 of the tubular post 24. As can be seen in FIG. 5, the tubular post 24 is adapted to allow the dielectric 204 to fit relatively snugly into the longitudinal opening 26, and the jacket 210 and the braided shield 208 make contact with the rear end 32 of the tubular post 24. Referring now to FIG. 6, the coaxial cable connector 10 is rotated in a clockwise direction relative to coaxial cable 200, and more specifically, the hollow body 12 and the tubular post 24 are rotated relative to the coaxial cable 200 in a clockwise manner. (It should be noted that the coaxial cable may also be rotated relative to the coaxial cable connector or they may both be rotated relative to one another). As the coaxial cable connector 10 is rotated clockwise and pushed toward coaxial cable 200, the tubular post 24 is forced between the dielectric 204 and the braiding shield 208 with the jacket 210. Advancement of the coaxial cable connector 10 (and more particularly the tubular post 24) relative to the coaxial cable 200 is assisted by the presence of the thread 38 on the outer surface 36 of the tubular post 24 as noted above.

As the coaxial cable connector 10 is advanced onto the coaxial cable 200, the braided shield 208 and jacket 210 are forced into the annular cavity 46 between the outside of tubular post 24 and the internal surface 28 of the hollow body 12. At the same time, the dielectric 204 and the inner conductor 202 are moved through the longitudinal opening 26 of the tubular post 24 and into opening 48 of the dielectric member 44. As the coaxial cable connector 10 is advanced, the inside surface 74 of pin 54 makes contact with the inner conductor 202 causing pin 54 to move along the longitudinal opening 48, pushing the elongated front portion 60 of pin 54 through the front end 50 of the dielectric member 44. The extension 66 moves and rotates with the dielectric member 44. It should be also noted, that as pin 54 advances longitudinally in longitudinal opening 48, the reduced diameter of the central portion 62 of dielectric member 44 pushes the four tines 72 inwardly to tightly grasp the inner conductor 202 of the coaxial cable 200.

Because the pin 54 and the dielectric member 44 are able to rotate relative to both the hollow body 12 and the tubular post 24 due to the extension 66 of pin 54 making contact with the dielectric member 44, when the tines 72 of pin 54 grasp the inner conductor 202 of coaxial cable 200, the pin 54 and the dielectric member 44 do not rotate with the hollow body 12 and tubular post 24 as they continue to rotate around the coaxial cable 200. Since the pin 54 and the dielectric member 44 do not rotate with the remainder of the coaxial cable connector 10, but remain stationary with the coaxial cable 200, pin 54 does not score or scratch the inner conductor 202.

Figure 7:
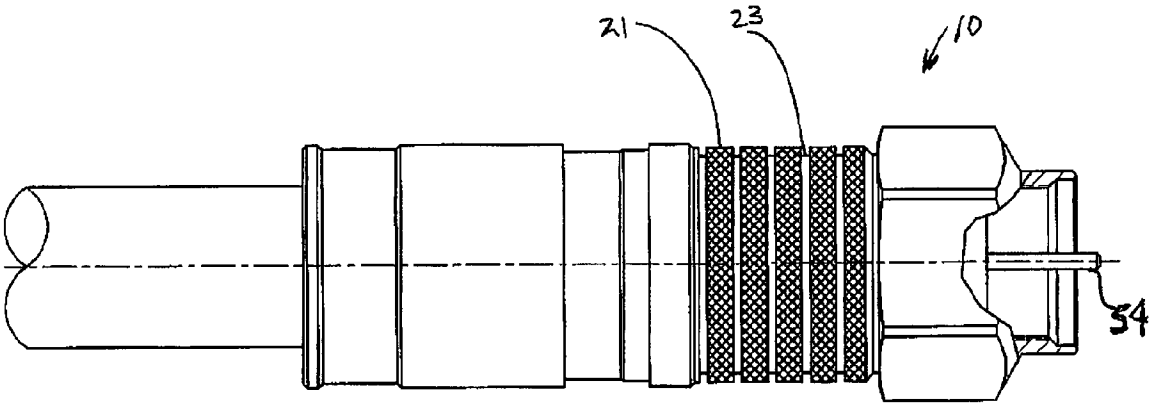
FIG. 7 is a side cutaway view of the connector of FIG. 6.

FIG. 7 illustrates the coaxial cable connector 10 with the coaxial cable 200 fully installed. It should be noted, that coaxial cable connector 10 in FIG. 7 is still in an uncompressed state. It should also be noted that pin 54, while illustrated in FIGS. 6–8 as protruding beyond coupling nut 16 in the preferred embodiment, may also protrude to any point between the front end 50 of dielectric member 44 and the front end of coupling nut 16.

Figure 8:
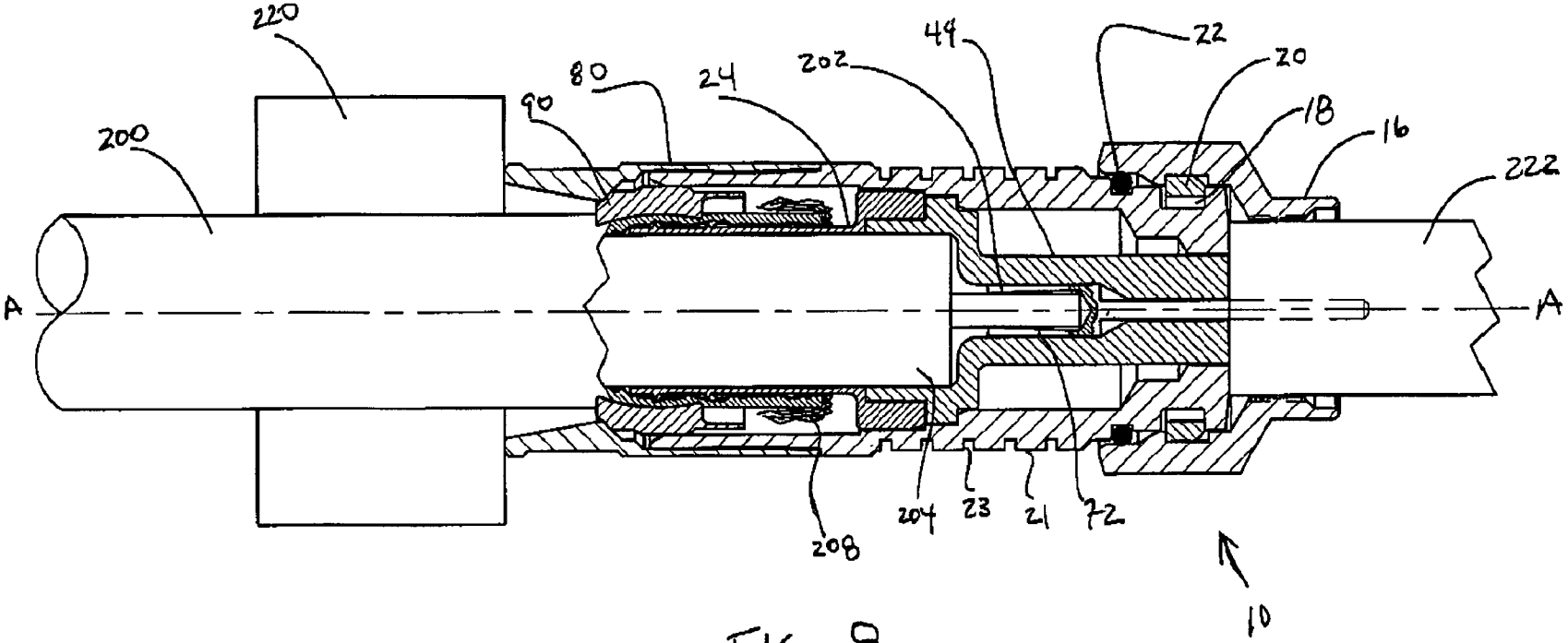
FIG. 8 is a side cutaway view of the connector of FIG. 6 after axial compression by a compression tool.

FIG. 8 illustrates the coaxial cable connector 10 and a closed configuration with a portion 220,222 of a tool used to axially compress the coaxial cable connector 10. Again, this procedure is fully described and illustrated in co-pending application Ser. Nos. 11/012,507 filed on Dec. 14, 2004, and assigned to the same assignee and incorporated herein in its entirety by reference, and also application Ser. No. 11/233,887, filed concurrently herewith, which is a continuation-in-part of application Ser. No. 11/012,507, also incorporated herein in its entirety by reference.

Another embodiment of coaxial cable connector 10' is illustrated in FIG. 9. In this embodiment, rather than having a knurled surface 21 and grooves 23, the connector has a generally hexagonal outer configuration 21'. Otherwise, the coaxial cable connector 10' can be the same as coaxial cable connector 10.

In order to assist in inserting a coaxial cable connector 10 (or any other similar coaxial cable connector) onto coaxial cable 200, an interface tool may be used. One such interface tool is illustrated in FIGS. 10–11. The interface tool 300 has an elongated body 302, a first end 304, and a second end 306, the second end 306 having threads on the outside surface to engage coaxial cable connector 10 via the internal threads of the coupling nut 16. When the interface tool 300 is tightly threaded onto the coaxial cable connector 10, the hollow body 12 will rotate with the interface tool 300. As can be seen in FIG. 11, the elongated body 302 has an first opening 308 in the second end 306 configured to receive the pin 54 and/or inner conductor 202. However, as can be seen in FIG. 10, it is impossible to tell if or how far the pin 54 and/or inner conductor 202 has protruded past the coupling nut 16. Without being able to determine how far pin 54 and/or inner conductor 202 has protruded past the coupling nut 16, it is very difficult to determine if the coaxial cable connector 10 has been correctly installed on coaxial cable 200.

A new interface tool 300' according to the present invention is illustrated in FIGS. 12–14. As with the prior embodiment, new interface tool 300' has an elongated body 302', a first end 304', a second end 306', with the second end 306' having threads 308' on an outside surface 310'. The interface tool 300' also has a longitudinal axis C—C and a first opening 312' to receive a conductor 314' that extends from the coaxial cable connector 316'. It should be noted that the conductor may be a pin from the coaxial cable connector 316' or a conductor from the coaxial cable 200', depending on the type of coaxial cable connector 316' that is attached to the coaxial cable 200'. Interface tool 300' also has at least one second opening 318', which is in communication with the first opening 312' and is transverse, and preferably orthogonal, to the first opening 312' and the longitudinal axis C—C. The second opening 318', which is illustrated as being a cylindrical opening, may be of any appropriate size and/or shape. The second opening 318' allows the user to view the conductor 314' as it moves out of the coaxial cable connector 316', which allows the user to know when the coaxial cable 200' has been correctly inserted into the coaxial cable connector 316' by the length or the presence of a visible conductor 314' that is visible in the second opening 318'. By allowing the user to see the conductor 314', the user can avoid stopping too soon, or can avoid over rotating or pushing the coaxial cable into the coaxial cable connector too far.

While two such second openings 318' are provided in the interface tool 300' illustrated in FIGS. 12–14, there need only be one such opening, but there may also be as many as appropriate for the size, shape and construction of the interface tool.

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

What is claimed is:

1. A connector for coupling an end of a coaxial cable to a terminal, the coaxial cable comprising an inner conductor, a dielectric surrounding the inner conductor, an outer conductor surrounding the dielectric, a braided shield surrounding the dielectric, and a jacket surrounding the braided shield, the connector comprising:

a hollow body having a rear end, a front end, and an internal surface extending between the rear and front ends of the body, the internal surface defining a longitudinal opening;

a tubular post disposed at least partially within the longitudinal opening of the hollow body, the tubular post having a rear end, an inner surface and an outer surface, the rear end of the tubular post having at least one thread on the outer surface, and wherein at least a portion of the outer surface of the tubular post and at least a portion of the internal surface of the hollow body define an annular cavity therebetween;

an insulating member disposed within the longitudinal opening of the hollow body, the insulating member having a front end, a rear end, and an opening extending between the front and rear ends, at least a portion of rear end of the insulating member being in contact with a portion of the inner surface of the tubular post; and a pin inserted into and substantially along the opening of the insulating member, wherein the pin and insulating member are rotatable together relative to the hollow body member and tubular post.

2. The connector of claim 1, wherein at least a portion of the tubular post frictionally engages at least a portion of the internal surface of the hollow body.

3. The connector of claim 1, wherein the pin has a flared portion at the rear end to assist in guiding the inner conductor of the coaxial cable into physical and electrical contact with the pin.

4. The connector of claim 1, wherein the pin has a first position and a second position, in the first position the pin is substantially disposed within the opening of the insulating member and in the second position a distal end of the pin extends beyond a front end of the connector.

5. The connector of claim 1, further comprising a knurled surface area on at least a portion of an external surface of the hollow body.

6. The connector of claim 1, further comprising a coupler disposed proximate the front end of the hollow body.

7. The connector of claim 1, wherein the pin has an extension extending in a radially outward direction, the extension engaging the insulating member to prevent rearward motion of the pin relative to the insulating member.

8. The connector of claim 3, wherein the extension extends around a circumference of the pin.

9. The connector of claim 1, wherein the opening of the insulating member has a first diameter at the rear end, a second diameter in a middle portion, and a third diameter at the front end.

10. The connector of claim 9, wherein the first diameter is greater than the second diameter and the second diameter is greater than the third diameter.

11. The connector of claim 9, wherein the pin has a first position and a second position, in the first position the flared portion of the pin is disposed in the opening of the insulating member having the first diameter and, in the second position, the flared portion of the pin is disposed in the opening of the insulating member having the second diameter and the flared portion of the pin is closed to a size about that of the internal conductor of the coaxial cable.

12. The connector of claim 1, further comprising:

a compression ring having a rear end, a front end surrounding at least a portion of the hollow body, and an inner surface defining a longitudinal hole extending between the rear and front ends of the compression ring;

a deformable gripping ring disposed between the hollow body and the inner surface of the compression ring, the gripping ring comprising a rear end, a front end, an outer surface, and an inner surface.

13. The connector of claim 12 wherein at least part of the deformable gripping ring is disposed within the annular cavity.

14. The connector of claim 12 wherein at least part of the deformable gripping ring surrounds at least part of the at least one thread.

15. A connector for coupling an end of a coaxial cable to a terminal, the coaxial cable comprising an inner conductor, a dielectric surrounding the inner conductor, an outer conductor surrounding the dielectric, a braided shield surrounding the dielectric, and a jacket surrounding the braided shield, the connector comprising:

a hollow body having a rear end, a front end, and an internal surface extending between the rear and front ends of the body, the internal surface defining a longitudinal opening;

a compression ring comprising a rear end, a front end surrounding the hollow body, and an inner surface defining a longitudinal opening extending between the rear and front ends of the compression ring;

a tubular post disposed at least partially within the longitudinal opening of the hollow body, the tubular post having a rear end, an inner surface and an outer surface, the rear end of the tubular post having at least one thread on the outer surface, and wherein at least a portion of the outer surface of the tubular post and at least a portion of the internal surface of the body define an annular cavity therebetween;

an insulating member disposed within the longitudinal opening of the hollow body, the insulating member having a front end, a rear end, and an opening extending between the front and rear ends, at least a portion of rear end of the insulating member disposed within the annular cavity of the tubular post; and a pin inserted into and substantially along the opening of the insulating member, wherein the pin and insulating member are rotatable together relative to the hollow body member and tubular post; and a deformable gripping ring disposed between the hollow body and the inner surface of the compression ring, the gripping ring comprising a rear end, a front end, an outer surface, and an inner surface;

wherein the compression ring is axially movable over the hollow body between a rearward position and a forward position;

wherein, in the rearward position, the inner surface at the rear end of the gripping ring has a rear inner diameter, and the inner surface at the front end of the gripping ring has a front inner diameter; and wherein, in the forward position, the gripping ring is compressed between the hollow body and the compression ring, the rear end of the gripping ring has a reduced rear inner diameter less than the rear inner diameter, and the front end of the gripping ring has a reduced front inner diameter less than the second front diameter.

16. The connector of claim 15, wherein at least a portion of the tubular post frictionally engages at least a portion of the internal surface of the hollow body.

17. The connector of claim 15, wherein the pin has a flared portion at the rear end to assist in guiding the inner conductor of the coaxial cable into physical and electrical contact with the pin.

18. The connector of claim 15, wherein the pin has a first position and a second position, in the first position the pin is substantially disposed within the opening of the insulating member and in the second position a distal end of the pin extends beyond a front end of the connector.

19. The connector of claim 15, further comprising a knurled surface area on at least a portion of an external surface of the hollow body.

20. The connector of claim 15, further comprising a coupler disposed proximate the front end of the hollow body.

21. The connector of claim 15 wherein, in the forward position, at least part of the deformable gripping ring is disposed within the annular cavity.

22. The connector of claim 15 wherein, in the forward position, at least part of the deformable gripping ring surrounds at least part of the at least one thread.

23. The connector of claim 15, wherein the pin has an extension extending in a radially outward direction, the extension engaging the insulating member to prevent rearward motion of the pin relative to the insulating member.

24. The connector of claim 23, wherein the extension extends around a circumference of the pin.

25. A combination of a coaxial cable and a connector for coupling an end of the coaxial cable to a terminal, the coaxial cable comprising an inner conductor, a dielectric surrounding the inner conductor, an outer conductor surrounding the dielectric, a braided shield surrounding the dielectric, and a jacket surrounding the braided shield, the connector comprising:

a hollow body having a rear end, a front end, and an internal surface extending between the rear and front ends of the body, the internal surface defining a longitudinal opening;

a tubular post disposed at least partially within the longitudinal opening of the hollow body, the tubular post having a rear end, an inner surface and an outer surface, the rear end of the tubular post having at least one thread on the outer surface, and wherein at least a portion of the outer surface of the tubular post and at least a portion of the internal surface of the hollow body define an annular cavity therebetween, wherein the inner surface is configured to allow the dielectric and the inner conductor to enter the tubular post and to allow the braided shield and the jacket to enter the annular cavity;

an insulating member disposed within the longitudinal opening of the hollow body, the insulating member having a front end, a rear end, and an opening extending between the front and rear ends, at least a portion of rear end of the insulating member being in contact with a portion of the inner surface of the tubular post and sized to receive a portion of the dielectric; and a pin inserted into the opening of the insulating member, wherein the pin and insulating member are rotatable together relative to the hollow body member and tubular post, and wherein a portion of the pin surrounds a portion of the inner conductor thereby being in electrical communication therewith.

26. The combination of claim 25 wherein the connector further comprises a compression ring comprising: a rear end, a front end surrounding the hollow body, and an inner surface defining a longitudinal opening extending between the rear and front ends of the compression ring; and a deformable gripping ring disposed between the hollow body and the inner surface of the compression ring.

27. The combination of claim 26 wherein at least part of the deformable gripping ring is disposed within the annular cavity.

28. The combination of claim 26 wherein at least part of the deformable gripping ring surrounds at least part of the at least one thread.

29. The combination of claim 26 wherein at least part of the cable is sandwiched between the deformable gripping ring and at least part of the at least one thread.

* * * * *